US007626105B2

(12) United States Patent
Rovner

(10) Patent No.: US 7,626,105 B2
(45) Date of Patent: Dec. 1, 2009

(54) HIGH-PERFORMANCE MOUTHPIECE FOR WOODWIND INSTRUMENTS

(76) Inventor: Philip Lee Rovner, 23 Tintern Ct. #301, Timonium, MD (US) 21093

( * ) Notice: Subject to any disclaimer, the term of this patent is extended or adjusted under 35 U.S.C. 154(b) by 0 days.

(21) Appl. No.: 12/040,976

(22) Filed: Mar. 3, 2008

(65) Prior Publication Data

US 2009/0217799 A1 Sep. 3, 2009

(51) Int. Cl.
*G10D 9/02* (2006.01)

(52) U.S. Cl. ..... 84/383 R

(58) Field of Classification Search ..... 84/383 R
See application file for complete search history.

(56) References Cited

U.S. PATENT DOCUMENTS

| | | | | | |
|---|---|---|---|---|---|
| 1,771,157 | A * | 7/1930 | Arthur | 84/383 R |
| 2,368,556 | A * | 1/1945 | Maccaferri | 84/383 R |
| 2,411,692 | A * | 11/1946 | Murano | 84/383 R |
| 2,517,077 | A * | 8/1950 | Berry | 84/383 R |
| 2,525,523 | A * | 10/1950 | Chance | 84/383 R |
| 3,150,554 | A * | 9/1964 | Leloup | 84/383 R |
| 3,521,517 | A * | 7/1970 | Sato | 84/383 R |
| 4,308,781 | A * | 1/1982 | McGuerty | 84/383 R |
| 4,517,875 | A * | 5/1985 | Dossekker | 84/383 R |
| 5,018,425 | A * | 5/1991 | Rovner | 84/383 R |
| 5,105,701 | A * | 4/1992 | Hall et al. | 84/383 R |
| 5,192,821 | A | 3/1993 | Goldstein et al. | |
| 5,293,805 | A * | 3/1994 | Guardala et al. | 84/383 R |
| 5,357,837 | A | 10/1994 | Disera | |
| 5,419,229 | A | 5/1995 | Van Doren | |
| 5,456,152 | A * | 10/1995 | Cusack et al. | 84/383 R |
| 5,623,111 | A | 4/1997 | Van Doren et al. | |
| 5,998,715 | A | 12/1999 | Rovner | |
| 6,118,060 | A | 9/2000 | Van Doren | |
| 7,326,840 | B2 * | 2/2008 | Wanne | 84/383 R |
| 7,465,864 | B2 * | 12/2008 | Heintz | 84/470 R |
| 7,470,844 | B2 * | 12/2008 | Espina | 84/383 R |
| 2005/0087057 | A1 * | 4/2005 | Taillard | 84/383 R |
| 2006/0272473 | A1 * | 12/2006 | Kuo | 84/383 R |

* cited by examiner

*Primary Examiner*—Jeffrey Donels
*Assistant Examiner*—Robert W Horn
(74) *Attorney, Agent, or Firm*—George Willinghan; August Law, LLC

(57) ABSTRACT

An improved mouthpiece for use with single reed woodwind instruments is provided. The mouthpiece includes rounded portions of the top surfaces of the side rails and tip rail that surround a window of the mouthpiece that leads to an internal tone chamber. The rounded surfaces reduce turbulence in the air flow during the reed closure segment of the oscillatory cycle, improving tonality, response and intonation. The mouthpiece also includes a step or raised portion in the table portion of the mouthpiece adjacent the window. The step elevates the heel end of the reed. The raised heel end permits increased vibration of the heel end of the reed, improving performance. In addition, the mouthpiece includes a transition from the tone chamber to the central bore of the mouthpiece that minimizes lateral offset and the offset angle of the transition, reducing energy reflection that degrades performance.

14 Claims, 3 Drawing Sheets

HIGH-PERFORMANCE MOUTHPIECE FOR WOODWIND INSTRUMENTS

FIELD OF THE INVENTION

The present invention relates to woodwind instruments and in particular to mouthpieces for woodwind instruments.

BACKGROUND OF THE INVENTION

Woodwind musical instruments, e.g., saxophones and clarinets, and other devices such as bird calls utilize the vibration of a reed in response to a flow of air to generate a tone. These reeds include natural cane reeds and synthetic reeds. Tone generation in general depends on proper reed vibration. The reed is typically placed in contact with a mouthpiece to cover an opening or window. The reed is held in place by an adjustable clamp or ligature that surrounds the mouthpiece and the reed. Variations in the mouthpiece and ligature affect the vibration of the reed and, therefore, the performance or tone of the device or instrument.

The essential function of the mouthpiece of a woodwind instrument is to provide support for the reed over an aperture that allows the reed to vibrate and to direct the energy from the reed vibration through the aperture and into the bore of the instrument. The function and performance of a mouthpiece is influenced by the arrangement and geometry of the facing around the aperture as well as of the route from the aperture to the bore. The facing is conventionally a flat surface on the mouthpiece surrounding the aperture, and the reed is placed in contact with this flat surface, covering the aperture. The facing includes the aperture, called a window, and the window is surrounded by a table on one end, two side rails extending from the table and a tip rail opposite the table. The reed functions as a reed valve during vibration, opening and closing the window. In conventional mouthpieces, the reed is affixed tightly against the flat portion of the facing to secure the mounting of the reed and to affect an airtight seal of the reed with the mouthpiece.

SUMMARY OF THE INVENTION

The present invention is directed to mouthpieces that provide for increased performance in a woodwind instruments through improvements in the interface between the reed and the mouthpiece. These improvements include changes to the interface between the window and the mouthpiece bore, modification of the shape of the portions of the side and tip rails that are in contact with the reed and improvements to the table by elevating the heel end of the reed. Contouring the top surfaces of the side and tip rails to induce a smoother airflow during that period of the oscillatory cycle when the reed is about to complete the closure of the window significantly improves performance of the mouthpiece. The tops of the side and tip rails include a curvature that allows the reed to function as a reed valve during operation of the instrument. Elevating the heel end of the reed in a manner that does not cause any loss of air seal enhances the overall performance of the instrument. Minimizing sharp or step offsets in the route from the window to the bore through the mouthpiece improves intonation and performance from the mouthpiece.

Another performance-enhancing modification to the mouthpiece involves mismatching the plan profile of the tip of the mouthpiece to the tip profile of the reed such that the ellipticity of the reed is greater than that of the tip profile of the mouthpiece. This contouring facilitates a new approach to the interface between the reed and the mouthpiece at the tip rail that enhances performance. Modifying the mouthpiece tip profile such that the center of rounded tip of the window is higher than the center of the reed profile at the reed tip enables the reed to contact the mouthpiece baffle slightly below the mouthpiece tip rail. This condition promotes an alteration of airflow in this region that enhances performance. This feature cannot be accomplished in a mouthpiece which has a conventionally machined facing as the sharp corners of such facings preclude the capability of the reed to effectively seal the window at the corners of the tip of the mouthpiece.

In one embodiment, the present invention is directed to a woodwind mouthpiece having a generally rectangular window exposing a tone chamber within the mouthpiece. This tone chamber is in communication with a central bore passing through the mouthpiece. A table is disposed at one end of the window and has a top to engage a portion of a reed adjacent a heel end of the reed. A pair of side rails extends from the table on either side of the window. Each side rail includes a side rail top surface. A tip rail extends between the side rails at an end of the window opposite the table. Each side rail top surface includes a rounded transition from at least one of an interior surface of that side rail to the side rail top surface and an exterior surface of that side rail to the side rail top surface. Each rounded transition runs at least partially along the top surface of each side rail. In one embodiment, each side rail top surface is a convex surface. In one embodiment, the rounded transition of each side rail top surface extends from a point of intersection of that side rail with the tip rail partially along the side rail top surface toward the table.

In one embodiment, the tip rail has a top surface with a rounded transition from at least one of an interior surface of the tip rail to the tip rail top surface and an exterior surface of the tip rail to the tip rail top surface. The tip rail rounded transition can extend completely along the tip rail from one side rail to the other side rail. In one embodiment, the tip rail top surface is a convex surface.

The present in invention is also directed to a woodwind mouthpiece having a generally rectangular window exposing a tone chamber within the mouthpiece. The tone chamber is in communication with a central bore passing through the mouthpiece. A table is disposed at one end of the window and includes a top to engage a portion of a reed adjacent a heel end of the reed. A pair of side rails extends from the table on either side of the window. Each side rail has a side rail top surface. A tip rail extends between the side rails at an end of the window opposite the table, and a step extends up from the table top a height sufficient to space a portion of the reed from the table top. In one embodiment, this portion of the reed is the heel end of the reed. In one embodiment, the table top includes a first surface disposed between the window and the step. The step elevates the reed above a portion of the first surface. In one embodiment, the table top includes a second surface extending above the first surface by the step height. The step is disposed between the first surface and the second surface and elevates the heel end of the reed above the second surface. In one embodiment, the first surface has a length from the window to the step of about 1.25 inches, and the step height is from about 0.03125 inches to about 0.0625 inches.

The present invention is also direct to a woodwind mouthpiece having a generally rectangular window exposing a tone chamber within the mouthpiece. The tone chamber is in communication with a central bore passing through the mouthpiece. A table is disposed at one end of the window and includes a top to engage a portion of a reed adjacent a heel end of the reed. A pair of side rails extends from the table on either side of the window. Each side rail has a side rail top surface. A tip rail extends between the side rails at an end of the window opposite the table, and s step extends from the table top a sufficient distance to space a portion of the reed from the table top. Each side rail top surface Includes a rounded transition from at least one of an interior surface of that side rail to the side rail top surface and an exterior surface of that side rail to the side rail top surface. In addition, each rounded transition runs at least partially along each side rail.

In one embodiment, each side rail top surface is a convex surface. In one embodiment, the rounded transition of each side rail top surface extends from a point of intersection of that side rail with the tip rail partially along the side rail top surface toward the table. In one embodiment, the tip rail has a top surface that includes a rounded transition from at least one of an interior surface of the tip rail to the tip rail top surface and an exterior surface of the tip rail to the tip rail top surface. In one embodiment, the portion of the reed spaced above the table is the heel end of the reed. In one embodiment, the table top includes a first surface disposed between the window and the step such that the step elevates the reed above a portion of the first surface. In one embodiment, the table top includes a second surface extending above the first surface by the step height. In addition, the step is disposed between the first surface and the second surface and elevates the heel end of the reed above the second surface. In one embodiment, the first surface has a length from the window to the step of about 1.25 inches, and the step height is from about 0.03125 inches to about 0.0625 inches.

DETAILED DESCRIPTION

Figure 1:
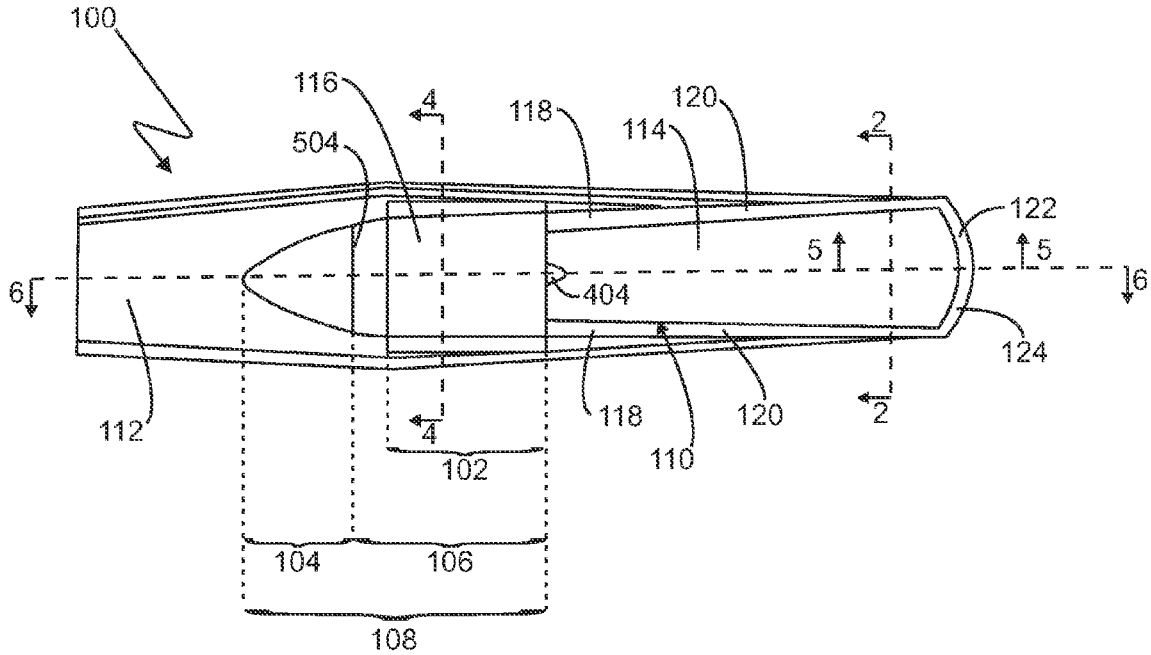
FIG. 1 is a plan view of a bottom side of a mouthpiece in accordance with the present invention.

Referring initially to FIG. 1, an exemplary embodiment of a mouthpiece 100 in accordance with the present invention is illustrated. The mouthpiece 100 is for use with a single reed woodwind instrument, for example a clarinet or saxophone. In general, the mouthpiece is arranged to support a reed that is secured to the mouthpiece with a ligature. Suitable arrangements of reeds and ligatures are known and available in the art. The mouthpiece has a typically elongated shape that tapers to either end. On a bottom side 112 of the mouthpiece is an elongated window 110 having a generally rectangular shape. The side of the mouthpiece containing the window is considered the bottom side, because that side typically faces down or is on the bottom of the mouthpiece when the mouthpiece is attached to a musical instrument. For purposes of the present description, the mouthpiece is viewed in an inverted orientation.

Figure 4:
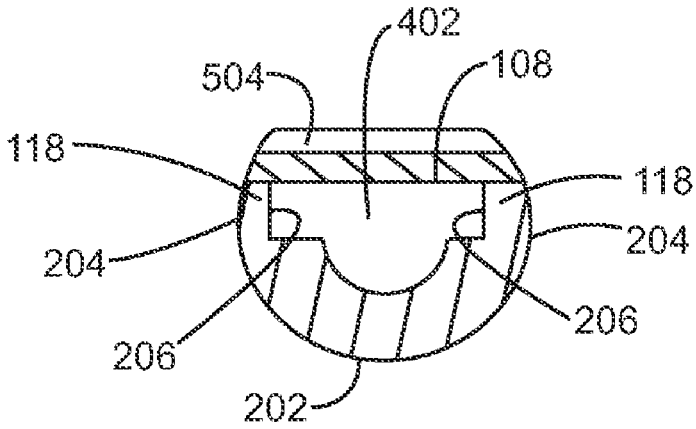
FIG. 4 is a view through line 4-4 of FIG. 1 with the bottom side facing upwards.

The window 110 exposes a tone chamber 114 within the mouthpiece. In one embodiment, the tone chamber has a rectangular cross section. The tone chamber is in communication with a central bore 402 (FIG. 4) passing through the mouthpiece. The central bore is arranged to attach to the woodwind instrument. In general, the mouthpiece includes a tapered reduced rear portion that is adapted to fit to the woodwind instrument in a conventional manner. The central bore has a length necessary to telescopically receive a neckpiece of the woodwind instrument. In one embodiment, the central bore is cylindrical. A table 108 is disposed at one end of the window. The table is a flat surface on the bottom side of the mouthpiece and is situated to engage a portion of a reed adjacent the heel end of the reed. This flat surface is the top 116 of the table, and the top engages the portion of the reed adjacent the heel end of the reed. The ligature securing the reed to the mouthpiece surrounds the mouthpiece around the table region of the mouthpiece. In one embodiment, the table has an overall length of about 1.9375" to about 2".

The mouthpiece also includes a pair of side rails 118. Each side rail frames one side of the window. The side rails extend from the table. In one embodiment, the side rails extend perpendicularly from the table. Alternatively, the side rails flair outwards as they extend from the table. The side rails are parallel in that the side rails do not cross or intersect in the region of the window. Each side rail includes a side rail top surface 120 running along the length of the side rail. The top surface of each side rail contacts a portion of the reed. In one embodiment, each side rail has a length of about 2" to about 2.125", and each side rail top surface has a width of about 0.0625" to about 0.125". In one embodiment, the width of each side rail top surface varies from about 0.125" at the table to about 0.0625" at the other end of the side rail. In one embodiment, each side rail top surface is coplanar with the table top. Alternatively, each side rail top surface is coplanar with the table top at the point of intersection of the side rail with the table top and subsequently curves away from the plane of the table top in the direction of the top side 202 (FIG. 2) of the mouthpiece. The top side 202 of the mouthpiece is opposite the bottom side 112. The curvature provides for separation between the reed and the side rail top surfaces at an end of the reed opposite the heel end. This separation occurs, for example, when the reed is attached to the mouthpiece and is not vibrating. Vibration of the reed causes the reed to come into contact with the side rail top surfaces along the entire length of the top rails. The reed in combination with the window acts as a valve for the tone chamber.

The mouthpiece also includes a tip rail 122. The tip rail extends between the side rails at an end of the window opposite the table. In one embodiment, the tip rail extends along a generally straight line between the side rails. Preferably, the tip rail follows an outward arc between the side rails. The tip rail is in contact with the reed when the reed vibrates to close the window into the tone chamber. In one embodiment, the tip rail spans a distance between the side rails of from about 0.625" to about 0.75 inches. The shape of the tip rail can be the same as the shape of the tip of the reed or can be an arc having a different curvature than the tip of the reed. The tip rail includes a tip rail top surface 124. The tip rail top surface is the portion of the tip rail that comes onto contact with the reed. In one embodiment, the tip rail top surface has a width of up to about 0.0625 inches. In one embodiment, the tip rail top surface is coplanar with the side rail top surfaces at the points of intersection between the side rails and the tip rail.

Figure 2:
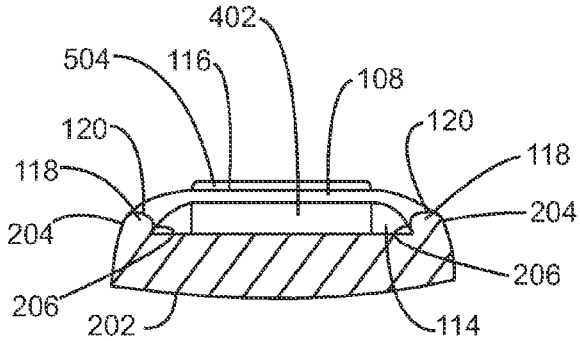
FIG. 2 is a view through line 2-2 of FIG. 1 with the bottom side facing upwards.
Figure 3:
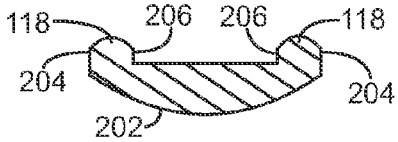
FIG. 3 is the view of FIG. 2 with the background elements removed for clarity.
Figure 8:
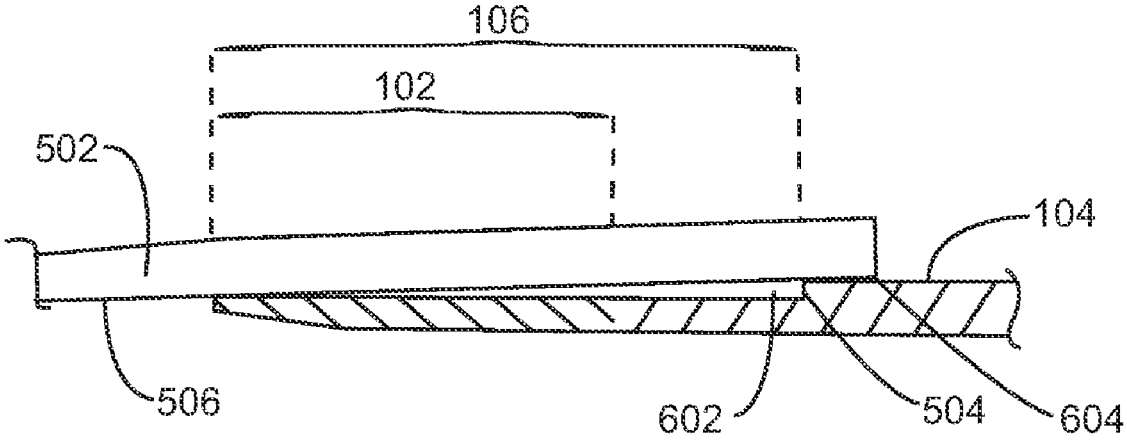
FIG. 8 is an exploded view of Section A of FIG. 7.

Referring to FIGS. 2 and 3, the top surface 120 of each side rail 118 includes a rounded transition from at least one of an interior surface 206 of that side rail to the side rail top surface 120 and an exterior surface 204 of that side rail to the side rail top surface. The interior surfaces of the side rails from the side walls of the tone chamber and the exterior surfaces are part of the exterior of the mouthpiece. Preferably, both the interior and exterior corners of the top surfaces of the side rails are rounded. Therefore, each side rail top surface comprises a convex surface. The rounded transitions extend at least partially along the top surface of each side rail, from the tip rail to the table. The portions of the side rail top surface that are not rounded are substantially flat. In one embodiment, each rounded portion of the side rail top surface extends from a point of intersection of that side rail with the tip rail partially along the side rail top surface toward the table. Rounding of the transition from the top to the side of the side rails to form the rounded or convex shape eliminates sharp edges flat surfaces. In addition, the amount of side rail top surface in contact with the reed is reduced. During the negative pressure portion of the oscillatory cycle of the reed, when the reed is being drawn towards closure with the side rails, the rounded surfaces effect a venturi, reducing airflow turbulence and resulting in a more liquid, less gritty tonal quality. In addition, an improvement in response, intonation, and tonal size is produced.

Figure 5:
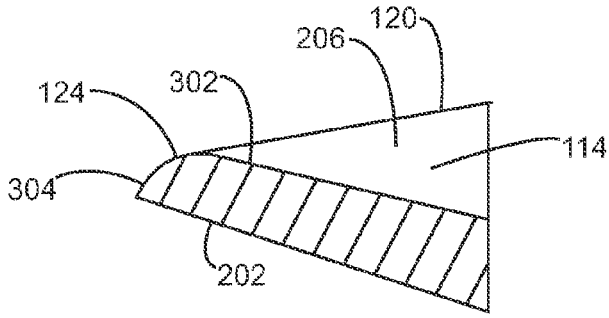
FIG. 5 is a view through line 5-5 of FIG. 1 with the bottom side facing upwards.

Referring to FIG. 5, in one embodiment, the top surface 124 of the tip rail includes a rounded transition from at least one of an interior surface 302 of the tip rail to the tip rail top surface and an exterior surface 304 of the tip rail, i.e., the end of the mouthpiece, to the tip rail top surface. In one embodiment, the exterior rounded transition can continue all the way to the top side 202 of the mouthpiece. In one embodiment, the tip rail rounded transition extends completely along the tip rail from one side rail to the other side rail. In one embodiment, the tip rail top surface is a convex surface. The rounded tip rail top surface provides the same benefits as the rounded side rail top surfaces.

Figure 6:
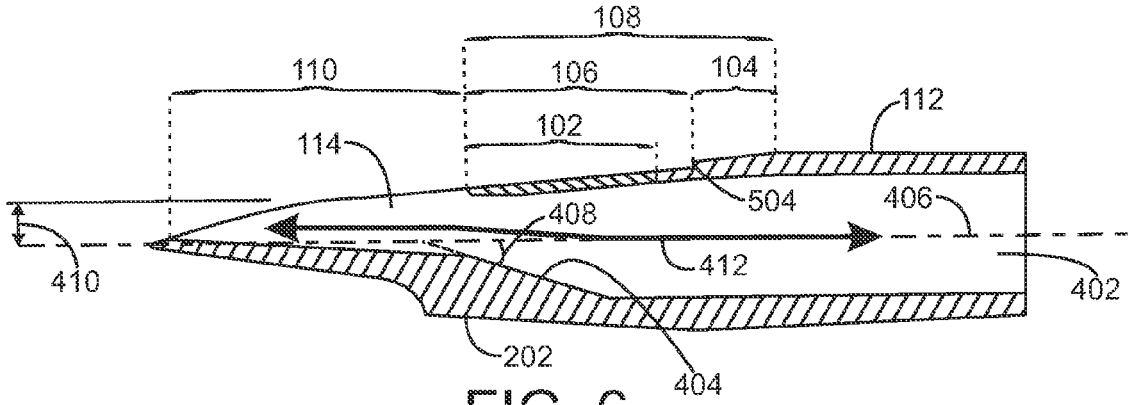
FIG. 6 is a view through line 6-6 of FIG. 1 with the bottom side facing upwards.
Figure 7:
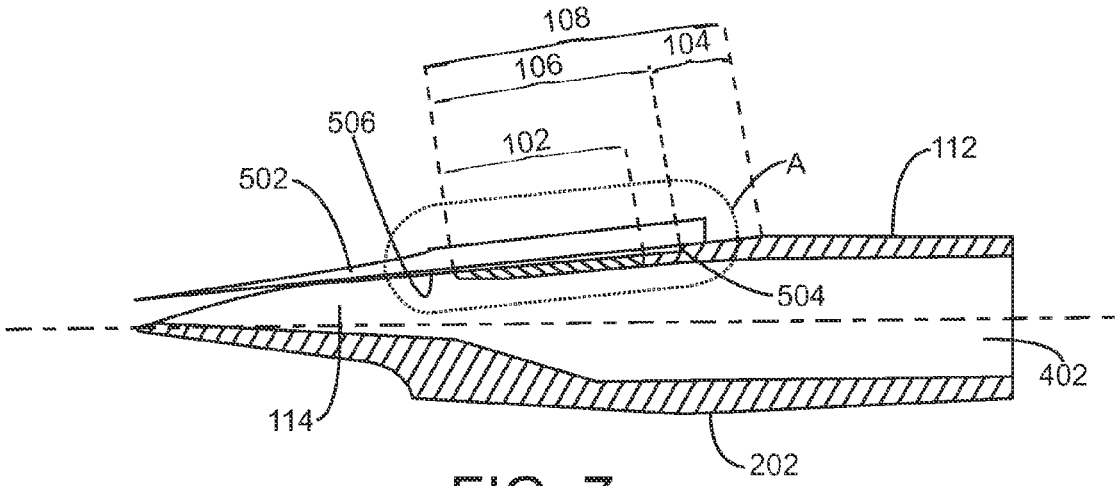
FIG. 7 is the view of FIG. 6 showing a reed in contact with the mouthpiece.

Referring to FIG. 6, a transition is provided internal to the mouthpiece between the tone chamber 114 and the internal bore 402. This transition region is bounded on one side by a portion of the table and on the other side by a wall 404 that is preferably has the shape of a shallow spoon shaped cavity. This transition area merges the bore into the tone chamber. In accordance with one exemplary embodiment of the present invention, the offset from the longitudinal axis 406 caused by the spoon shaped cavity is minimized. In one embodiment, the wall 404 forms an angle of less than about 15° 408 with respect to the longitudinal axis 406 of the bore. Therefore, abrupt sharp changes in cross section, as found in the prior art, that cause impedance discontinuities, energy reflection and acoustical filtering are reduced. This arrangement also reduces the lateral offset 410 of the table, eliminating the lateral vectoring 412 of the air column through the mouthpiece. Empirical testing has demonstrated an improvement in the resonant quality or "Q" of mouthpieces of the present invention. In addition, the elimination of abrupt changes in cross section and a lessening of the baffle angle reduce wave front reflections, enhancing response and tonal center.

In one embodiment, the reduced offset is achieved, at least in part, by stretching or extending the overall length of the mouthpiece. In addition, reduction of the offset results in a reduction of the thickness of the mouthpiece in the region of the table. Since machining a suitably thin table from a single piece is difficult and can result in breakage, in one embodiment, a separate table portion 102 is created and is bonded to the mouthpiece, for example using adhesives or heat bonding techniques. The separate table portion is preferably the portion of the table adjacent the window 110. In one embodiment, the portion extends from the window a distance of from about 1" to about 1.0625". The width is this separate portion is greater than the width of the window as is best shown in FIG. 1. The material for the separate portion can be the same as the entire mouthpiece or the separate portion can be formed from a separate material.

Referring to FIGS. 4 and 6-8, in one embodiment, the mouthpiece includes a step 504 that extends up from the table top 116. In one embodiment, the step spans the entire width of the table and has a height sufficient to space at least one portion of the underside 506 of a reed 502 covering the window and the table top from the table top. This height can be less than about 0.0625" to less than about 0.03125". In one embodiment, the portion of the underside of the reed that is spaced from the table top includes the heel end of the reed. The step divides the table top into two surfaces, a first surface 106 and a second surface 104. The first surface is disposed between the window 110 and the step 504. In one embodiment, the step elevates a portion of the underside of the reed above this first surface, forming a gap 602 between the underside of the reed and the first surface. The first surface has a length from the window to the step of about 1.25 inches. The second surface extends above the first surface by the step height, and a space 604 is created between the heel of the reed and the second surface. In general, the step is disposed between the first surface and the second surface. Although shown as a step in the table top, other structures can be used to space one or more portions of the underside of the reed from the table top.

The raised step causes the heel end of the reed to be bent away from the table in a way which does not affect the air seal. In addition, a portion of the middle of the reed is elevated above the table top. This spacing permits the heel end of the reed to vibrate more freely then when constrained tightly against the table. When a resilient type ligature is used in conjunction with this feature, the result is a noticeable improvement in playing performance.

While it is apparent that the illustrative embodiments of the invention disclosed herein fulfill the objectives of the present invention, it is appreciated that numerous modifications and other embodiments may be devised by those skilled in the art. Additionally, feature(s) and/or element(s) from any embodiment may be used singly or in combination with other embodiment(s) and steps or elements from methods in accordance with the present invention can be executed or performed in any suitable order. Therefore, it will be understood that the appended claims are intended to cover all such modifications and embodiments, which would come within the spirit and scope of the present invention.

What is claimed is:

1. A woodwind mouthpiece comprising:

a generally rectangular window exposing a tone chamber within the mouthpiece, the tone chamber in communication with a central bore passing through the mouthpiece;

a table disposed at one end of the window, the table comprising a top to engage a portion of a reed adjacent a heel end of the reed;

a pair of side rails extending from the table on either side of the window, each side rail comprising a side rail top surface;

a tip rail extending between the side rails at an end of the window opposite the table; and a step extending up from the table top a height sufficient to space a portion of the reed from the table top.

2. The mouthpiece of claim 1, wherein the portion of the reed comprises the heel end of the reed.

3. The mouthpiece of claim 1, wherein the table top comprises a first surface disposed between the window and the step, the step elevating the reed above a portion of the first surface.

4. The mouthpiece of claim 3, wherein the table top comprises a second surface extending above the first surface by the step height, the step disposed between the first surface and the second surface and elevating the heel end of the reed above the second surface.

5. The mouthpiece of claim 3, wherein the first surface comprises a length from the window to the step of about 1.25 inches.

6. The mouthpiece of claim 1, wherein the step height comprises from about 0.03125 inches to about 0.0625 inches.

7. A woodwind mouthpiece comprising:

a generally rectangular window exposing a tone chamber within the mouthpiece, the tone chamber in communication with a central bore passing through the mouthpiece;

a table disposed at one end of the window, the table comprising a top to engage a portion of a reed adjacent a heel end of the reed;

a pair of side rails extending from the table on either side of the window, each side rail having a side rail top surface;

a tip rail extending between the side rails at an end of the window opposite the table; and a step extending from the table top a sufficient distance to space a portion of the reed from the table top;

wherein each side rail top surface comprises a rounded transition from at least one of an interior surface of that side rail to the side rail top surface and an exterior surface of that side rail to the side rail top surface, each rounded transition running at least partially along each side rail.

8. The mouthpiece of claim 7, wherein each side rail top surface comprises a convex surface.

9. The mouthpiece of claim 8, wherein the rounded transition of each side rail top surface extends from a point of intersection of that side rail with the tip rail partially along the side rail top surface toward the table.

10. The mouthpiece of claim 7, where the tip rail comprises a top surface comprising a rounded transition from at least one of an interior surface of the tip rail to the tip rail top surface and an exterior surface of the tip rail to the tip rail top surface.

11. The mouthpiece of claim 7, wherein the portion of the reed comprises the heel end of the reed.

12. The mouthpiece of claim 7, wherein the table top comprises a first surface disposed between the window and the step, the step elevating the reed above a portion of the first surface.

13. The mouthpiece of claim 12, wherein the table top comprises a second surface extending above the first surface by the step height, the step disposed between the first surface and the second surface and elevating the heel end of the reed above the second surface.

14. The mouthpiece of claim 12, wherein the first surface comprises a length from the window to the step of about 1.25 inches and the step height comprises from about 0.03125 inches to about 0.0625 inches.

* * * * *